United States Patent [19]

Himmelbauer

[11] 4,376,907

[45] Mar. 15, 1983

[54] TELEVISION CAMERA TUBE WITH DIODE ELECTRON GUN

[75] Inventor: Erich E. Himmelbauer, Eindhoven, Netherlands

[73] Assignee: U.S. Philips Corporation, New York, N.Y.

[21] Appl. No.: 166,510

[22] Filed: Jul. 7, 1980

[30] Foreign Application Priority Data

Jul. 12, 1979 [NL] Netherlands ..... 7905440
Apr. 8, 1980 [NL] Netherlands ..... 8002037

[51] Int. Cl.[3] ..... H01J 29/48; H01J 29/62; H01J 31/38

[52] U.S. Cl. ..... 313/389; 313/452

[58] Field of Search ..... 313/384, 449, 452, 389, 313/390, 448, 447

[56] References Cited

U.S. PATENT DOCUMENTS

| | | | |
|---|---|---|---|
| 2,310,811 | 2/1943 | Schantl et al. | 313/451 |
| 2,443,916 | 6/1948 | Kelar | 313/451 |
| 3,278,779 | 10/1966 | Szegho | 313/447 |
| 3,870,002 | 3/1975 | Van Roos Malen | 313/449 X |
| 3,894,261 | 7/1975 | Corson | 313/452 X |

*Primary Examiner*—Palmer C. Demeo
*Attorney, Agent, or Firm*—Robert J. Kraus

[57] ABSTRACT

A television camera tube having a diode electron gun comprising a cathode and an anode having a central aperture. The part of the anode surrounding the central aperture is situated closer to the cathode than the remainder of the anode and has an area which is smaller than 75% of the cathode's emissive surface. This configuration minimizes anode current and avoids wasted power while retaining desirable electron beam characteristics.

9 Claims, 10 Drawing Figures

TELEVISION CAMERA TUBE WITH DIODE ELECTRON GUN

BACKGROUND OF THE INVENTION

The invention relates to a television camera tube comprising in an evacuated envelope a diode electron gun for generating an electron beam. The gun comprises centred along an axis, successively a cathode having an emissive surface extending substantially perpendicularly to the axis and an anode having a central aperture around the axis. A focusing lens is provided for focussing the electron beam on a photosensitive target on which a potential distribution is formed by projecting an optical image on it, which target, by scanning with an electron beam provides electrical signals corresponding to the optical image.

The photosensitive target often consists of a photoconductive layer which is provided on a signal plate. The potential distribution, sometimes termed the potential image, is formed on the photoconductive layer which may be considered as being composed of a large number of picture elements. Each picture element in turn may be regarded as a capacitor to which a current source is connected in parallel. The current at each element is substantially proportional to the light intensity on the element. The charge on each capacitor decreases linearly with time with constant light intensity. As a result of the scanning, the electron beam passes periodically through each picture element and again charges the capacitor, which means that the voltage across each picture element is periodically brought to approximately 45 volts. The quantity of charge which is periodically necessary to charge a capacitor is proportional to the light intensity on the respective picture element. The associated charge current flows via a signal resistor to a signal plate which all picture elements have in common. As a result of this, a voltage variation is formed across the signal resistor which represents, as a function of time the light intensity of the optical image, formed on the photosensitive target. A television camera tube having the described operation is termed a vidicon.

One of the aspects of a camera tube of the above-indicated kind is the response rate. This is the velocity with which the tube reacts to variations of the light intensity. This response rate is influenced inter alia by the fact that the charge which the electron beam supplies to a given picture element during the short time in which it passes the picture element depends on the velocity distribution of the electrons in the electron beam. This influence of the response rate is sometimes termed beam current-lag inertia. The velocity distribution of the electrons leaving the cathode depends on the temperature of the cathode and is referred to as Maxwell's distribution. As a result of mutual interactions between the electrons of the electron beam, an excess of fast electrons may be formed. This means that more fast electrons are present in the beam that can be expected according to Maxwell's distribution. This excess of fast electrons causes a detrimental influence of the beam current-lag inertia and hence the response rate.

In a triode electron gun having successively a cathode, a negative grid and an anode as described in the article "Een kleine experimentele kleurentelevisiekamera" ("A small experimental colour television camera") in Philips Technisch Tijdschrift, volume 29, 1968, No. 11, a beam cross-over is formed by a lens between the cathode and the anode. Many interactions take place in the cross-over so that the beam current-lag inertia is adversely influenced. By ensuring that the current density of the electron beam in an electron gun does not substantially increase from the cathode to the anode, the beam current-lag inertia is considerably reduced.

A diode electron gun having a considerably smaller beam current-lag inertia than triode electron guns is disclosed in U.S. Pat. No. 3,831,058. In the gun described in this patent, the current density during scanning of the electron beam in any point along the axis between the cathode and the anode is at most three times the current density in the point of intersection of the axis with the cathode. For reducing the beam current-lag inertia it has in fact proved of importance to restrict the number of mutual interactions between the electrons in the electron beam. The grid used in this electron gun is made strongly negative only during the flyback period of the frame, to suppress electron emission during this period. As compared with the aperture in the anode, the aperture in the grid is very large (respective diameters are 0.75 mm and 0.02 mm. This will hereinafter be referred to as a diode electron gun of the first type).

Another type of diode electron gun which also has a small beam current-lag inertia is described in abandoned U.S. patent application Ser. No. 877,080. The electron gun described in this application has two anodes, one behind the other, instead of one anode. The diameter of the aperture in the first anode which, of the two anodes, is situated closer to the cathode, is at least twice as large as the diameter of the aperture in the second anode. The second anode is at a potential of at least 100 volts relative to the cathode and has a potential which is at least 10× higher than the potential of the first anode so that a lens is formed between the two anodes. However, the aperture in the first anode must be so small that the lens does not substantially influence the emission of the cathode. This gun has the advantage that dynamic beam control is possible without a large cathode load being necessary. Moreover it has been found that the so-called "return beam effect," an interference signal which is caused by fast secondary electrons which are liberated from the anode by the returning electron beam, does not occur to any substantial extent.

A diode electron gun as described in the opening paragraph is disclosed in U.S. Pat. No. 3,894,261. The part of the anode containing the aperture is secured to the remainder of the anode on the cathode side. However, the two described embodiments of diode electron guns have the disadvantage that the cathode emits over a very large part of the cathode surface. Since the emissive surface of the cathode is much larger than the surface of the aperture in the first anode, a very large part of the electron current in a diode gun is intercepted by the first anode. The current which occurs is sometimes termed the anode current. This causes extra power dissipation, in particular when dynamic beam current control is used. Thus the voltage source for the control signal for the dynamic beam must be capable of supplying considerable peak currents (for example, up to 10 mA).

Decreasing the emissive surface by making the cathode smaller is not attractive, because this would shorten the life time of the cathode.

SUMMARY OF THE INVENTION

It is therefore an object of the invention to provide a television camera tube comprising a diode electron gun in which the anode current is smaller than in prior art guns while maintaining a small beam current-lag inertia.

According to the invention, a device of the kind described in the opening paragraph is characterized in that the part of the anode surrounding the central aperture has an area which is smaller than 75% of the cathode's emissive surface. The emissive surface is usually circular, however, the emissive surface may also be elliptical or rectangular in shape. By constructing, the anode in this manner, the electric field between the cathode and the anode near the centre of the emissive surface and opposite to the aperture in the anode is strongest so that the region opposite to the part of the anode comprising the aperture will emit most strongly. Beyond said region the emission decreases as a result of the decreasing electric field strength. As a result of this the current density will decrease towards the edge of the emissive surface and consequently the overall anode current will also decrease. The anode preferably has the shape of a truncated cone, the flat top portion of which surrounds the central aperture and has an area which is smaller than 75% of the emissive surface.

In another embodiment, the anode comprises a metal plate having a central aperture, formed in a collar extending in the direction of the cathode. This embodiment is very simple to manufacture from sheet material by means of a deep-drawing process.

A further embodiment of a device in accordance with the invention is characterized in that the part of the anode comprising the central aperture is situated in or substantially in the aperture in a grid which has a negative potential relative to the cathode, which grid and part of the anode are equidistant from the emissive surface. In this embodiment of the invention, it is possible to cause electrons to be emitted only from a small part of the cathode's emissive surface. This is done by moving the anode towards the cathode and in to the aperture in the grid, so that the grid and the part of the anode surrounding the aperture are situated at a substantially equal distance from the cathode. As a result of this, the emission of the cathode is restricted to a circular area which has a smaller diameter than the central aperture in the grid, without undesired lens effects occurring in the area between the cathode and the anode, thus avoiding an increase in the beam current-lag inertia. This results in a drastically reduced anode current. The diode electron gun maintains its small beam current-lag inertia, and the cathode maintains a long life because a monolayer of barium on the non-emissive part of the cathode surface migrates to the emissive part of the cathode surface.

This embodiment of the invention may be used in both of the above-described types of diode electron guns. In the second type, the part of the first anode in which the central aperture is present is situated in or substantially in the aperture in the grid.

A preferred embodiment of a camera tube in accordance with the invention is characterized in that the anode of the electron gun has the shape of a hollow truncated cone and the flat top portion of the truncated cone is coaxial and situated in one plane or substantially in one plane with the grid.

In order to restrict emission from the cathode to a small area, the cameras tube is preferably manufactured so that the diameter of the smallest aperture in the grid is less than 1 mm and the diameter of the smallest aperture in the anode is less than 0.3 mm. The flat top portion of the anode as used in the first preferred embodiment preferably has a diameter which is less than 0.5 mm.

Another preferred embodiment of a camera tube in accordance with the invention is characterized in that the anode is provided in the form of an electrically conductive layer on the side of a plate of insulating material remote from the cathode. The grid is also provided in the form of an electrically conductive layer on the side of the plate facing the cathode. The plate has a central aperture, and the electrically conductive layer which forms the anode extends over the wall of the central aperture and over an area around the aperture on the cathode-facing side coaxially with the aperture in the layer forming the grid. The aperture in the plate preferably tapers in the direction of the cathode.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
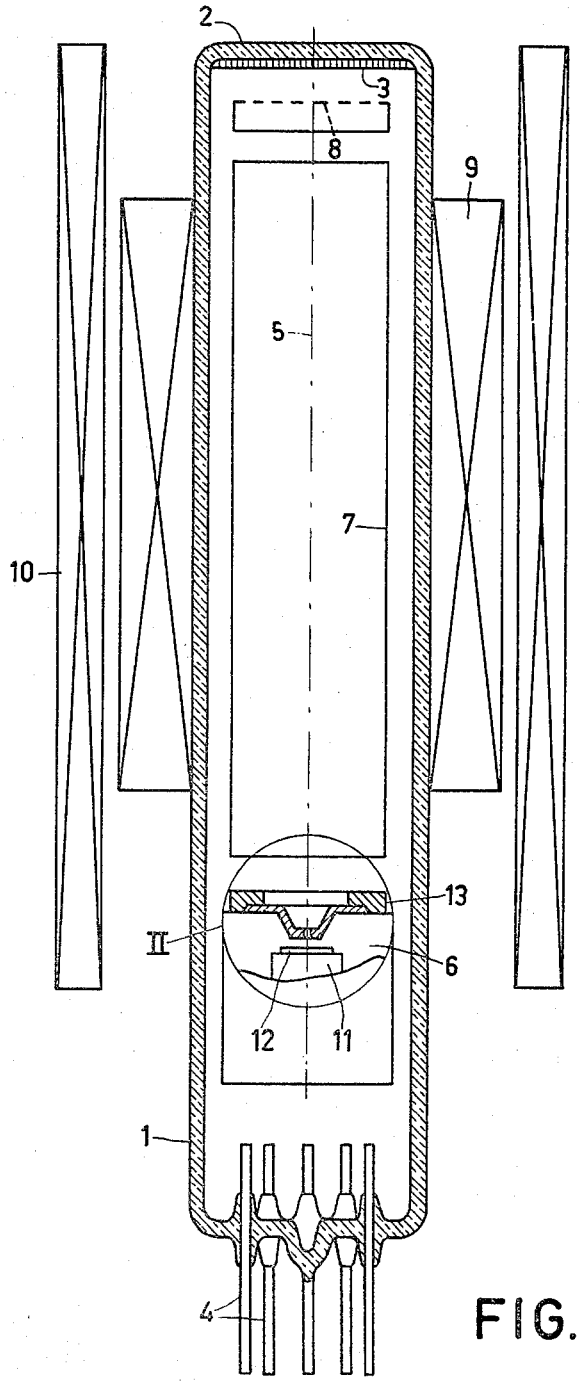
FIG. 1 is a diagrammatic longitudinal sectional view of a television camera tube in accordance with the invention.

The camera tube shown in FIG. 1 is of the "Plumbicon" type (registered Trade Mark of N. V. Philips). It comprises a glass envelope 1 having on one end a window 2 on the inside of which the photoconductive target 3 is provided. The target consists of a photoconductive layer and a transparent conductive signal plate between the photoconductive layer and the window. The photoconductive layer consists mainly of specially activated lead monoxide and the signal plate consists of conductive tin oxide. At the other end of the glass envelope 1, are the connection pins 4 of the tube. Centred along an axis 5, the camera tube comprises an electron gun 6 and a collector 7. Moreover, the tube has a gauze-like electrode 8 for effecting perpendicular landing of the electron beam on the target 3. Deflection coils 9 serve to deflect the electron beam generated by the electron gun 6 in two mutually perpendicular directions and to cause said beam to write a frame on the target 3. Focusing coil 10 focuses the electron beam on the target 3. The diode electron gun 6 comprises a cathode 11 having an emissive surface 12 and an anode 13. The inter-connection of the gun components and their connections to the pins 4 are not shown in the figure so as to avoid complexity of the drawing. The anode 13 is provided with a small aperture that forms a diaphragm.

Figure 2:
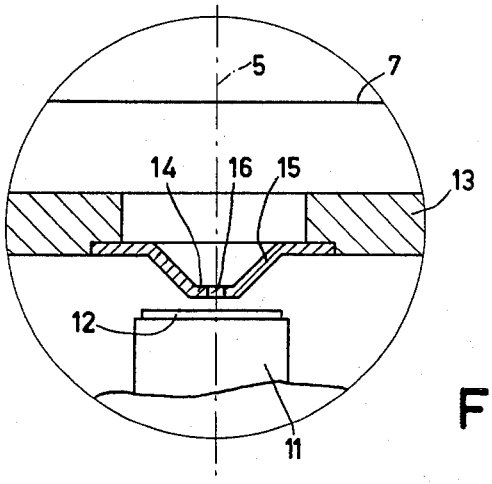
FIG. 2 shows a detail of FIG. 1, FIGS. 3 and 7 show the computed equipotential lines and electron paths (without space charge) in electron guns for a camera tube in accordance with the invention, and FIGS. 4, 5, 6, 8, 9 and 10 each show a detail of a sectional view of another embodiment of the invention.

FIG. 2 shows a detail of the electron gun. The cathode 11 has an emissive surface 12. The anode 13 is situated with its flat top portion 14 of the conical part 15 opposite to the emissive surface. The aperture 16 in the top portion 14 is so small (for example 0.02 mm) that it also forms a diaphragm for the electron beam.

Figure 3:
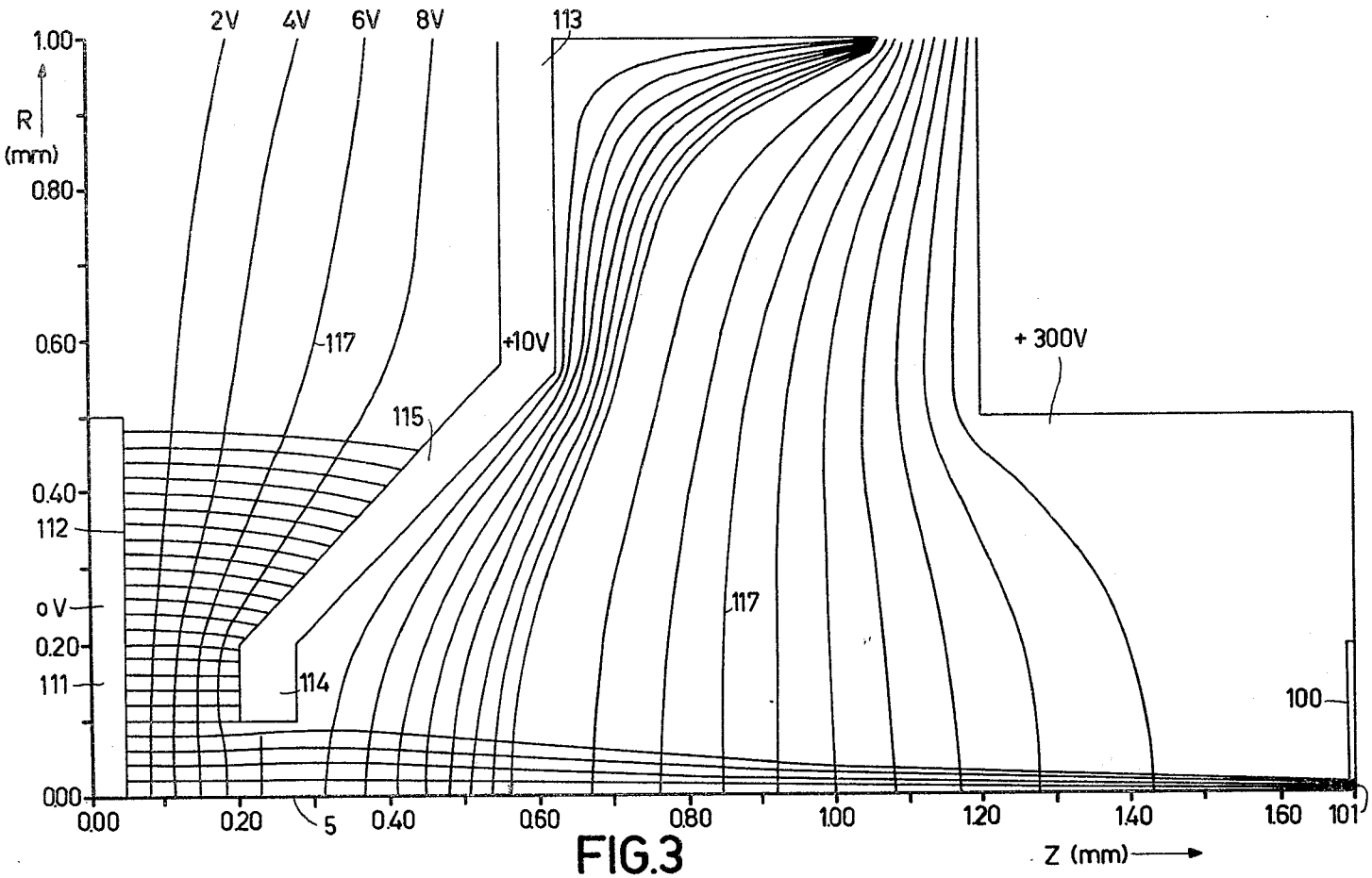

FIG. 3 shows a number of the computed paths 40 of the electrons which are emitted by the cathode 111 in a diode electron gun having the configuration shown in FIG. 2. Since the electron gun is rotationally symmetrical, only that part of the configuration is shown which is situated on one side of the axis of symmetry. The first anode 113 has a potential of +10 volts relative to the cathode 111 with emissive surface 112. The second anode has a potential of +300 volts and comprises a diaphragm 100 having an aperture 101, diameter 0.03 mm. The equipotential lines 117 are shown between the electrodes. Since the flat top portion 114 of the anode 113 opposite to the emissive surface 112 of the cathode 111 is situated at a much smaller distance from the cathode than the remainder of the anode, the field strength as a result of the potential difference between anode and cathode is largest in the centre. Therefore, the current density in the emitted electron beam is largest in a region in the centre of the emissive surface of the cathode and decreases towards the edge of the cathode. As a result of this the anode current also decreases.

Figure 4:
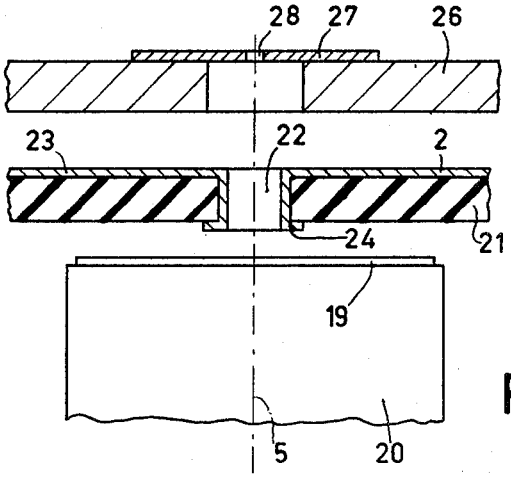

FIG. 4 shows another embodiment of a device having a diode electron gun, according to the invention. This type of electron gun has a first and a second anode. Opposite to the emissive surface 19 of the cathode 20 a ceramic plate 21 is provided which has an aperture 22. A metal layer 23 extends over the side of the ceramic plate remote from the cathode, along a surface of the plate defining aperture 22, and partially along the side of the plate nearest the cathode, forming a part 24. This metal layer forms the first anode. Aperture 22 may taper towards the cathode. The second anode 26 comprises a plate 27 having an aperture 28. The diameter of the aperture in the first anode is approximately 0.2 mm. The diameter of the aperture 28 in the plate 27 is 0.03–0.05 mm. The distance between the first and second anode along the axis is approximately 0.6 mm. The thickness of the ceramic plate is 0.3 mm.

Since only the small part 24 of the first anode is situated close to the emissive surface 19 of the cathode, the anode current which occurs is much smaller than in the conventional construction.

Figure 5:
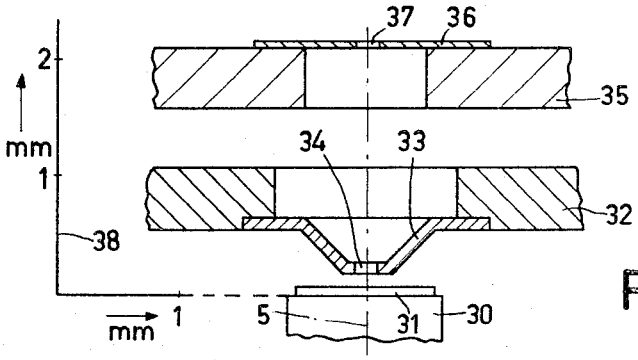

FIG. 5 shows an embodiment of a diode electron gun which comprises, centred around an axis, successively a cathode 30 with emissive surface 31, a first anode 32 having a part 33 which extends towards the cathode and has an aperture 34, and a second anode 35 having a plate 36 with a small aperture 37. The diameter of the top surface of the truncated cone is 0.4 mm and the diameter 34 is 0.2 mm. The aperture 37 has a diameter of 0.05 mm. Other dimensions can be determined by means of the scale 38 shown.

Figure 6:
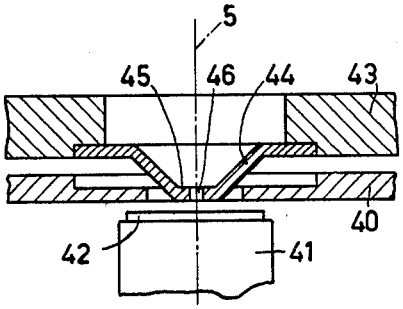

FIG. 6 is a sectional view of a diode electron gun as shown in FIG. 2 but this time with an extra grid 40. The cathode 41 comprises an emissive surface 42. The anode 43 has a conical portion 44 which has a flat top portion 45 which is situated opposite to the emissive surface 42 and which has an aperture 46. The portion 45 has a distance to the cathode approximately the same as grid 40.

Figure 7:
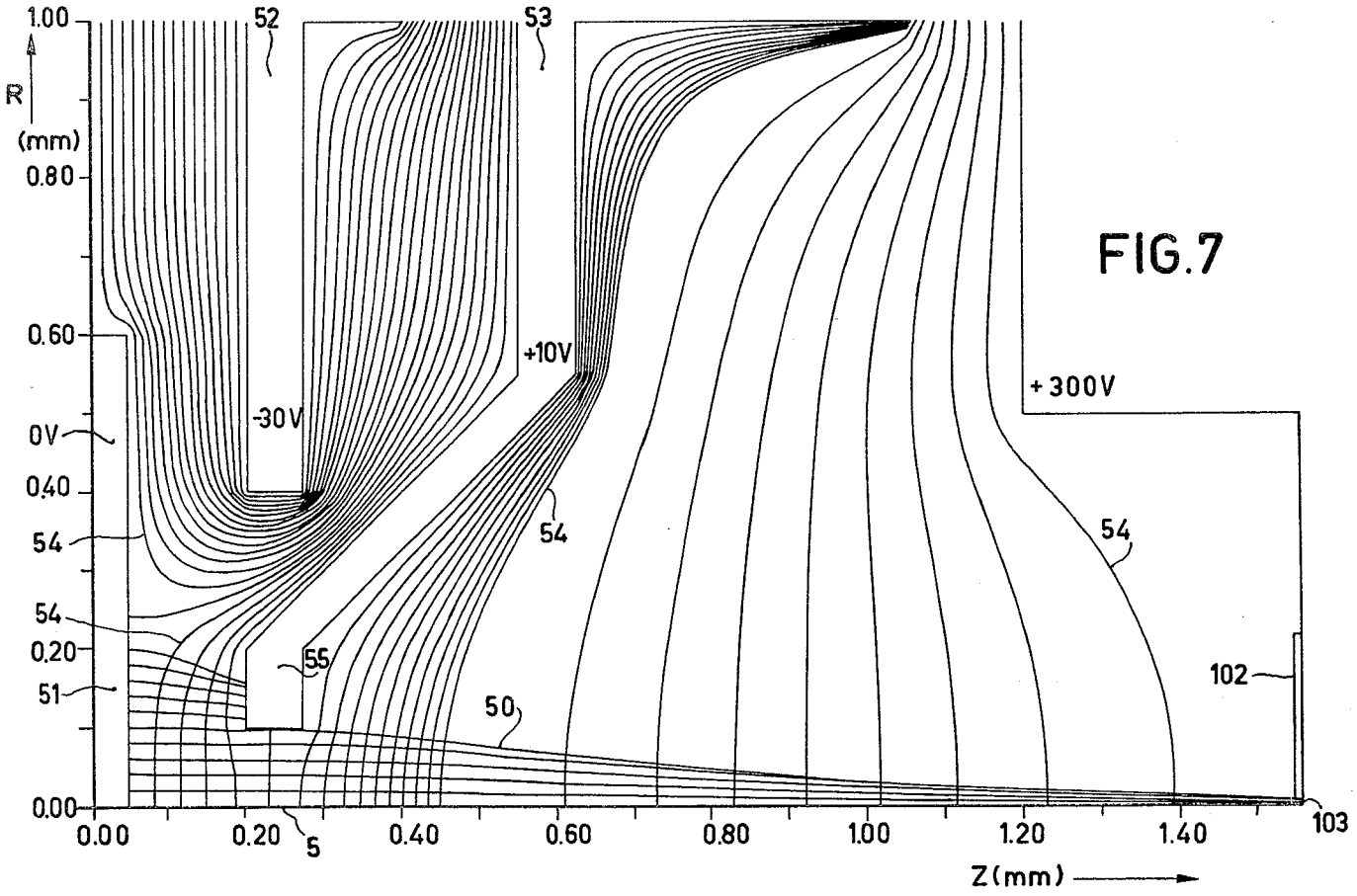

FIG. 7 shows a number of the computed paths 50 of the electrons which are emitted by the cathode 51 in a diode electron gun of the type shown in FIG. 6.

Since the electron gun is rotationally symmetrical, again only the part of the configuration is shown which is situated on one side of the axis of symmetry. The grid 52 has a potential of −30 volts relative to the cathode 51 and the first anode 53 has a potential of +10 volts relative to the cathode 51. The equipotential lines 54 are shown between the electrodes. The second anode has a potential of +300 volts and comprises a diaphragm 102 having an aperture 103 of diameter 0.03 mm. Since the flat top portion 55 of the first anode is situated in one plane with the grid 52, the emission of the cathode beyond a small central area having in this case a radius of 0.2 mm is strongly suppressed. This has a number of advantages. The anode current is restricted and thus there is a reduced power dissipation. The barium which at the surface of the cathode forms the emissive monolayer migrates over the cathode surface towards the emissive part. As a result of this gettering, the life of the cathode and hence of the camera tube is extended. Such a gun, as already said, also has a small beam current-lag inertia.

Figure 8:
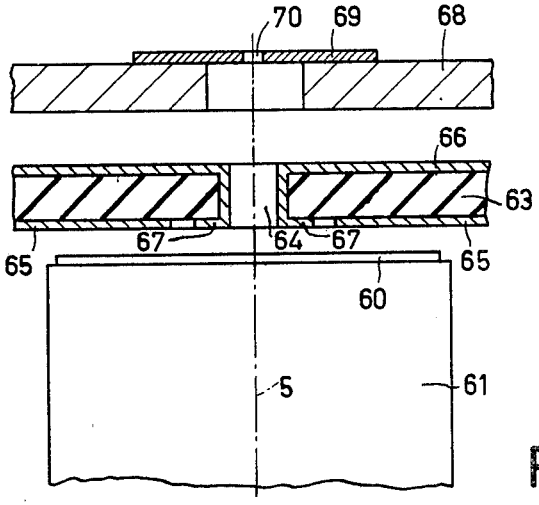

FIG. 8 shows another embodiment of a diode electron gun in accordance with the invention. This electron gun has a first and a second anode. Opposite to the emissive surface 60 of the cathode 61 a ceramic plate 63 is provided which has an aperture 64. On the side facing the cathode 61 a metal layer is provided which forms the grid 65. On the side remote from the cathode a metal layer 66 is provided which in addition extends over the wall of the aperture 64 and on the side facing the cathode around the aperture forms the part 67 which is situated in one plane with the grid, which layer forms the first anode. Aperture 64 may taper towards the cathode. The second anode 68 comprises a plate 69 having an aperture 70. The diameter of the aperture 64 in the first anode is approximately 0.2 mm. The diameter of the aperture 70 in plate 69 is 0.03–0.05 mm. The distance between the first and second anode along the axis is approximately 0.6 mm. The thickness of the ceramic plate is approximately 0.3 mm.

Figure 9:
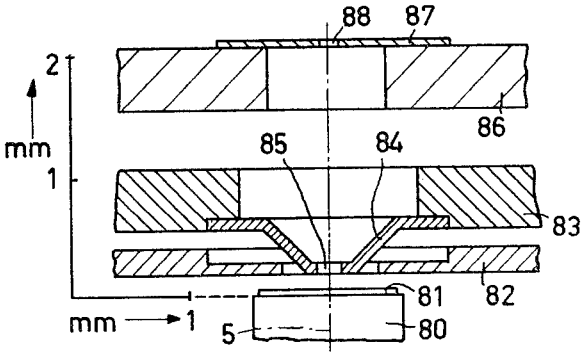

FIG. 9 shows a diode electron gun comprising, centred around an axis, successively a cathode 80 having an emissive surface 81, a grid 82, a first anode 83 having a part 84 with aperture 85 extending towards the grid, and a second anode 86 having a plate 87 provided with a small aperture 88. The diameter of the top surface of the truncated cone is 0.4 mm and the diameter of the aperture 85 is 0.2 mm. The aperture 88 has a diameter of 0.05 mm. The other dimensions can be determined by means of scale 89.

Figure 10:
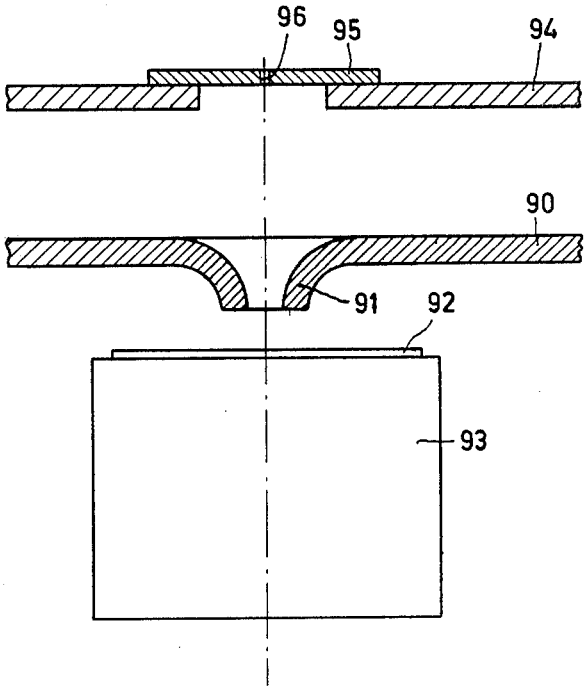

FIG. 10 is a sectional view of a last embodiment. The first anode 90 consists of a metal plate which has a deep-drawn collar 91 opposite to the emissive surface 92 of cathode 93. The second anode 94 again comprises a diaphragm 95 with an aperture 96.

It will be obvious that modifications are possible without departing from the scope of this invention. The part of the anode which is situated opposite to the emissive surface and comprises the central aperture, for example, need not be circular, as well as the emissive surface.

What is claimed is:

1. A television camera tube comprising a photosensitive target for producing electrical signals corresponding to an optical image formed thereon, a diode electron gun for producing an electron beam, and means for focussing the electron beam on the target, said diode electron gun including, arranged successively along an axis of the tube, a cathode having an emissive surface extending substantially perpendicularly to the axis and an anode having a central aperture around the axis, a part of the anode surrounding the central aperture being situated closer to the cathode than the remainder of the anode, said part of the anode having an area which is smaller than 75% of the emissive surface of the cathode.

2. A television camera tube as in claim 1 and further including a grid having an aperture in which the part of the anode surrounding the central aperture is situated, the grid and the part of the anode being substantially equally-spaced from the emissive surface of the cathode.

3. A television camera tube as in claim 1, characterized in that the anode is in the form of a hollow truncated cone of which the flat top portion is the part surrounding the aperture.

4. A television camera tube as in claim 1, characterized in that the anode comprises a metal plate having a central aperture, said aperture being formed in a collar extending in the direction of the cathode.

5. A television camera tube as in claim 2, characterized in that the anode of the electron gun is in the shape of a hollow truncated cone having a flat portion situated coaxially and coplanar with the grid.

6. A television camera tube as in claim 2, characterized in that the smallest portion of the grid has a diameter smaller than 1 mm and the smallest portion of the aperture in the anode has a diameter smaller than 0.3 mm.

7. A television camera tube as claimed in claim 5, characterized in that the flat portion of the anode has a diameter which is smaller than 0.5 mm.

8. A television camera tube as in claim 2, characterized in that the anode is provided in the form of an electrically conductive layer on the side of a plate of insulation material remote from the cathode and the grid is provided in the form of an electrically conductive layer on the side of said plate facing the cathode, the plate having a central aperture, the electrically conductive layer which forms the anode further extending over the wall of the central aperture and over a region around the aperture on the side facing the cathode, coaxially with the aperture in the layer which forms the grid.

9. A television camera tube as in claim 8, characterized in that the aperture in the plate tapers towards the cathode.

* * * * *